US005256253A

United States Patent [19]

Zidovec et al.

[11] Patent Number: 5,256,253

[45] Date of Patent: Oct. 26, 1993

[54] METHODS FOR INHIBITING BARIUM SULFATE DEPOSITION USING A POLY(AMINE)COMPOUND OR ITS SALTS IN PAPERMAKING SYSTEMS

[75] Inventors: Davor F. Zidovec; Alexander D. Fisher; David D. Dreisbach, all of Jacksonville, Fla.

[73] Assignee: Betz PaperChem Inc., Jacksonville, Fla.

[21] Appl. No.: 934,841

[22] Filed: Aug. 24, 1992

[51] Int. Cl.[5] ..... D21H 17/56

[52] U.S. Cl. ..... 162/164.6; 162/166; 162/168.2; 162/199

[58] Field of Search ..... 162/164.6, 166, 168.2, 162/181.2, 199, DIG. 4; 252/8.552, 8.554; 526/271

[56] References Cited

U.S. PATENT DOCUMENTS

| | | | |
|---|---|---|---|
| 3,549,548 | 12/1970 | Newman | 252/181 |
| 4,190,462 | 2/1980 | De Jong et al. | 134/2 |
| 4,765,867 | 8/1988 | Dreisbach et al. | 162/DIG. 4 |
| 4,937,002 | 6/1990 | Bainbridge et al. | 252/8.554 |
| 5,038,861 | 8/1991 | Shuler | 252/8.552 |
| 5,059,333 | 10/1991 | Hen | 252/8.552 |

FOREIGN PATENT DOCUMENTS

| | | |
|---|---|---|
| 106323 | 4/1991 | European Pat. Off. . |
| 3-197690 | 8/1991 | Japan . |

OTHER PUBLICATIONS

Sanborn, J. R., "Non Biological Deposits Associated w/ Slime Problems", Paper Trade J., Mar. 29, 1965, pp. 42–43.

*Primary Examiner*—W. Gary Jones
*Assistant Examiner*—Dean Tan Nguyen
*Attorney, Agent, or Firm*—Alexander D. Ricci; Philip H. Von Neida

[57] ABSTRACT

The present invention provides for methods of inhibiting the formation and deposition of barium sulfate on the surfaces of papermaking systems. The inventive treatments comprise adding an effective amount of a poly(amine) compound to the papermaking systems. Representative polymers include polyallylamine, polytrimethylallylammonium chloride and polyvinylamine.

11 Claims, No Drawings

METHODS FOR INHIBITING BARIUM SULFATE DEPOSITION USING A POLY(AMINE)COMPOUND OR ITS SALTS IN PAPERMAKING SYSTEMS

FIELD OF THE INVENTION

The present invention pertains to methods for inhibiting barium sulfate scale formation in aqueous systems using Poly(amine) compounds and salts thereof.

BACKGROUND OF THE INVENTION

Barium sulfate scale formation has been experienced for many years in the petroleum industry. Its formation can prove problematic as its formation in drilling cases surrounding mud slurries and the like has impeded petroleum recovery and has caused fouling and deposit formation along drilling implements and oil recovery lines.

Barium sulfate deposition has also proved problematic in the pulp and papermaking industry. Barium is chemically bound to many types of woods and is released from the wood pulp during papermaking operations via ion exchange mechanisms. Sulfuric acid and alum (aluminum sulfate) are used extensively in papermaking, and as a result, sulfate ion concentrations can be quite high. This combination causes barium sulfate to readily precipitate in papermaking systems.

The problem does not appear to be isolated to any particular geographic region as it has been seen on groundwood machines, fine paper machines and unbleached kraft machines in all parts of the United States. Generally, deposits have been found in the screens, cleaners, fan pump, organ tubes, headbox, rectifier rolls, headbox lip and slice, and on the fourdrinier foils.

These deposits can lead to formation problems, fiber bundles or "twists" coming loose and causing holes in the sheet. Paper machine breaks can even occur due to crushouts at the presses. Deposition also provides a favorable location for sulfate reducing bacteria to fester, leading eventually to corrosion problems and subsequent papermaking problems.

Where barium sulfate deposition problems have been especially severe, dollar losses can be attributed to lost production because of off-spec paper and downtime for cleaning. Further monetary losses are due to labor and the mechanical costs of cleaning, as well as, shortened equipment life because of corroded headboxes. The problem is especially acute due to the low solubility of the compound in water.

SUMMARY OF THE INVENTION

The present invention relates to methods for inhibiting the formation and deposition of barium sulfate in papermaking systems by adding to the papermaking system a poly(amine) compound or a salt thereof.

Preferred compounds include polyallylamine, poly trimethylallyammonium chloride and polyvinylamine.

DESCRIPTION OF THE RELATED ART

Barium sulfate scale inhibition is taught in U.S. Pat. No. 3,549,548. Condensed polyphosphates and acrylic polymers are used in combination to treat scale formation. U.S. Pat. No. 4,190,462 teaches a process for dissolving barium sulfate in or around the borehole of a well using a monovalent cation salt of a monocyclic macrocyclic polyamine having at least two nitrogen-linked carboxymethyl groups.

Japanese patent 31-97690 teaches inhibition of scale in water systems employing a water-soluble polymer prepared by adding monochloroacetic acid to a poly(-vinylamine). European patent application 91-106,323 teaches the use of vinyl amine polymers as size-fixing aids in papermaking systems.

DETAILED DESCRIPTION OF THE INVENTION

The present invention relates to methods for inhibiting the formation and deposition of barium sulfate on the surfaces of papermaking systems comprising adding to said papermaking systems a poly(amine) compound or a salt thereof.

The poly(amine) compounds or salts thereof possess the structures

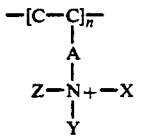

or

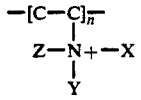

where A is a hydrocarbon chain containing from 1 to 5 carbon atoms, n ranges from 3 to about 500, and X, Y and Z are hydrogen or alkyl groups.

The poly(amine) compounds prove effective at inhibiting barium sulfate deposition in all phases of the papermaking system where water is employed and barium sulfate can form. These compounds will perform well in the presence of highly charged cations, such as $Al^{+3}$ and $Fe^{+3}$, and in a low pH environment. The preferred poly(amines) are polyallylamine, polytrimethylallylammonium chloride and polyvinylamine. These compounds are readily available from commercial sources. One such source is Aldrich Chemical Co.

The poly(amine) compounds can be applied for papermaking treatment in much the same way conventional papermaking treatments are applied. They may be added to the papermaking system at any stage of the system. They may be added directly to the pulp furnish or sprayed on wires, felts, press rolls or other deposition-prone surfaces. The poly(amine) compounds can be added to the papermaking system neat, as a powder, slurry or in solution; the preferred primary solvent being water but is not limited to such. The polymers may be added specifically and only to a furnish identified as contaminated or may be added to blended pulps. The polymers may be added to the stock at any point prior to the manifestation of the deposition problem and at more than one site when more than one deposition site occurs. Combinations of the above additive methods may also be employed by way of feeding the pulp millstock, feeding to the papermachine furnish, and spraying on the wire and felt simultaneously. The effective amount of these polymers to be added to the papermaking system depends on a number of variables, including the pH of the system, hardness of the water, alum, consistency, nature of the fiber, additional additives, and the amount of barium and sulfate ions present. Generally, 0.5 parts per million to about 50.0 parts per million is added to the papermaking system.

The molecular weights of these polymers expressed as MW(n) are preferably in the range of 100 to about 50,000. These polymers may be added to the papermaking system alone with other papermaking additives. These can include other polymers, starch and sizing aids.

The polymers are most effective in papermaking systems exhibiting an acidic pH (<7). They prove more effective than the polyphosphates and anionic polymers which are traditionally used to inhibit barium sulfate deposition. The poly(amine) polymers will also be effective in systems containing as many as 10 or more parts per million aluminum ion.

There are several advantages anticipated with the present invention as compared to prior processes. These advantages include the ability to function in an acidic pH, an ability to function in the presence of cations, the ability to function at low dosages, and a reduced environmental impact.

The data set forth below demonstrate the unexpected results occasioned by use of this invention. The following examples are included as being an illustration of the invention and should not be construed as limiting the scope thereof.

EXAMPLES

The static barium sulfate inhibition test consists of 100 ml of DI water in a 4 ounce glass bottle. 0.1 ml of a 0.19 g $Ba(NO_3)_2$/100 ml DI $H_2O$ solution is then added to provide 2 ppm $Ba^{+2}$. The desired treatment agent is then added. The pH is then adjusted to pH 5.5. 1 mi of a pH 5.5 adjusted solution of 14.79 g $Na_2SO_4$/100 ml DI $H_2O$ is then added to provide 1000 ppm $SO_4^{-2}$. This solution is then removed and filtered through 0.2 u filters (20 ml). The resultant solution is then analyzed by atomic absorption $$\% \text{ Inhibition} = \frac{\text{ppm soluble } Ba^{+2}(\text{treated}) - \text{ppm soluble } Ba^{+2}(\text{control})}{\text{ppm soluble } Ba^{+2}(\text{measured max.}) - \text{ppm soluble } Ba^{+2}(\text{control})}$$

The results of this testing is presented in Tables I and II.

TABLE I

| Treatment Agent (ppm) | pH | Aluminum (ppm) | % Inhibition |
|---|---|---|---|
| Control | — | — | 0 |
| A (10) | 5.5 | — | 100 |
| A (10) | 4 | — | 100 |
| A (5) | 4 | 2 | 100 |
| A (10) | 4 | 2 | 89 |
| A (10) | 5.5 | 2 | 97 |
| B (10) | 5.5 | — | 9 |
| C (10) | 5.5 | — | 100 |
| C (10) | 5.5 | 2 | 97 |
| C (10) | 4 | — | 95 |
| C (2.5) | 4 | 2 | 100 |
| C (5) | 4 | 2 | 100 |
| D (10) | 5.5 | — | 87 |
| E (10) | 5.5 | — | 8 |
| F (10) | 5.5 | 0 | 16 |
| G (10) | 5.5 | 0 | 14 |
| H (10) | 5.5 | 0 | 14 |
| I (10) | 5.5 | 0 | 3 |
| J (1) | 5.5 | 0 | 100 |

TABLE I-continued

| Treatment Agent (ppm) | pH | Aluminum (ppm) | % Inhibition |
|---|---|---|---|
| J (5) | 5.5 | 2 | 10 |

A = Polytrimethylallylammonium chloride (10 cps/30% solution)
B = Polytrimethylallylammonium chloride (25 cps/30% solution)
C = Polyallylamine
D = Polyallylamine (MW (n) = 8,500–11,000) available as Aldrich 28321-5
E = Polyallylamine (MW(n) = 50,000–65,000) available as Aldrich 28322-3
F = Copolymer of dimethyldiallylammonium chloride/acrylic acid
G = Polyethylenimine
H = Dimethylamine/epichlorohydrin/ethylenediamine terpolymer
I = Dimethylamine/epichlorohydrin copolymer
J = Polyphosphate available as Actophos ®

F, G, H and I indicate that polyamines with structures differing from those of the instant invention show low efficacy at inhibiting barium sulfate deposition. The polyphosphate, J, is effective in the absence of aluminum, while treatment agents A, B and C are not affected by the presence of aluminum.

These results reflect the efficacy of the poly(amine) compounds at inhibiting the formation of barium sulfate. The results further indicate that the lower molecular weight polymers are more effective at inhibiting barium sulfate formation.

Table II represents the environment of a papermaking system by having cellulose fiber (unbleached kraft pulp) present. Comparative testing was performed with a polyphosphate designated as Actophoss, available from Betz Laboratories, Inc., Trevose, Pa. These results are presented in Table II.

TABLE II

Barium sulfate Inhibition
pH = 4

| Treatment (ppm) | Cellulose fiber (g/l) | Aluminum (ppm) | % Inhibition |
|---|---|---|---|
| A (10) | 0 | 0 | 100 |
| A (10) | 0.2 | 0 | 6 |
| A (10) | 0 | 5 | 100 |
| A (10) | 0.2 | 5 | 37 |
| B (10) | 0 | 0 | 100 |
| B (10) | 0.2 | 0 | 100 |
| B (10) | 0 | 5 | 0 |
| B (10) | 0.2 | 5 | 0 |

A = Polytrimethylallylammonium chloride (10 cps/30% solution)
B = Sodium hexametaphosphate, available as Actophos ®

The results of Table II indicate that while the polymer is affected by the fiber, it regains its efficacy in the presence of aluminum while the polyphosphate is rendered completely in effective when aluminum is present in the system.

In accordance with the patent statutes, the best most of practicing the invention has been set forth. However, it will be apparent to those skilled in the art that many other modifications can be made without departing from the invention herein disclosed and described, the scope of the invention being limited only by the scope of the attached claims.

Having thus described the invention, what we claim is:

1. A method for inhibiting the formation and deposition of barium sulfate on the surfaces of papermaking systems comprising adding to said papermaking systems a poly(amine) compound or a salt thereof having the structure

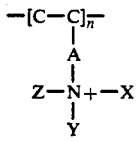

or

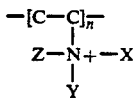

where A is a hydrocarbon chain containing from I to 5 carbon atoms, n ranges from 3 to about 500, and X, Y and Z are hydrogen or alkyl groups.

2. The method as claimed in claim I wherein said poly(amine) salt compound is polytrimethylallylammonium chloride.

3. The method as claimed in claim I wherein said poly(amine) is polyallylamine.

4. The method as claimed in claim 1 wherein said poly(amine) compound is polyvinylamine.

5. The method as claimed in claim 1 wherein said poly(amine) compound has a molecular weight of 100 to about 50,000.

6. The method as claimed in claim I wherein said papermaking system has an aqueous pH less than 7.

7. The method as claimed in claim 1 wherein said poly(amine) compound is added to said papermaking system with a different poly(amine) compound.

8. The method as claimed in claim 1 wherein said poly(amine) compound is contained in a carrier solvent.

9. The method as claimed in claim 8 wherein said carrier solvent is water.

10. The method as claimed in claim 1 wherein said poly(amine) compound is added to said papermaking system in an amount from about 0.5 part to about 50.0 parts per million parts.

11. The method as claimed in claim 1 wherein said papermaking system contains 10 or more parts per million parts aluminum.

* * * * *